US005739767A

United States Patent [19]

Carr

[11] Patent Number: 5,739,767

[45] Date of Patent: Apr. 14, 1998

[54] VEHICLE SAFETY WARNING SYSTEM

[76] Inventor: Asia Carr, 7155 S. Wabash St., Chicago, Ill. 60619

[21] Appl. No.: 513,073

[22] Filed: Aug. 9, 1995

[51] Int. Cl.[6] ..... G08G 1/00

[52] U.S. Cl. ..... 340/902; 340/901

[58] Field of Search ..... 340/901, 902, 340/904, 460

[56] References Cited

U.S. PATENT DOCUMENTS

| | | | |
|---|---|---|---|
| 3,873,963 | 3/1975 | Neal | 340/902 |
| 4,209,769 | 6/1980 | Cronerberry | 340/905 |
| 4,901,054 | 2/1990 | Waterman | 340/460 |
| 4,952,931 | 8/1990 | Serageldin | 340/901 |
| 5,278,553 | 1/1994 | Cornett | 340/903 |
| 5,280,632 | 1/1994 | Jung-Gon | 455/902 |
| 5,495,243 | 2/1996 | McKenna | 340/903 |

*Primary Examiner*—Jeffery Hofsass
*Assistant Examiner*—Mohammed R. Ghannan
*Attorney, Agent, or Firm*—McAndrews, Held & Malloy, Ltd.

[57] ABSTRACT

The present invention relates to a vehicle warning system device that is capable of detecting sirens of approaching emergency vehicles. This device includes a plurality of siren detectors, each siren detector capable of generating status signal at an output of each siren detector when activated by a siren. A plurality of visual indicators and a speaker. A microprocessor having a microprocessor plurality of input, a microprocessor plurality of output and a microprocessor memory, the microprocessor plurality of input connected to each output of the plurality of siren detectors, the microprocessor plurality of output connected both to the speaker and an input of each of the plurality of visual indicators.

2 Claims, 6 Drawing Sheets

31

VEHICLE SAFETY WARNING SYSTEM

FIELD OF THE INVENTION

The present invention relates generally to a safety system device, more particularly, the present invention relates to a safety warning system device for vehicles that can detect sirens of approaching emergency vehicles.

DESCRIPTION OF PRIOR ART

In today's crowded traffic conditions there are many instances where emergency vehicles such as police cars, ambulances, fire trucks are present. Often for a variety of reasons people sometimes do not hear the siren of the emergency vehicle and are unaware of its precense. This is a dangerous condition because it could cause accidents or endanger lives by merely delaying the emergency vehicle. People often do not hear the siren of such vehicles usually if they are playing their radio too loud, have defective hearing, distracted by other loud noises or are just not paying attention. Therefore, there is a need for a vehicle warning system that could detect and warn drivers of sirens from approaching emergency vehicles.

Numerous innovations for warning system devices have been provided in the prior art that are described as follows. Even though these innovations may be suitable for the specific individual purposes to which they address, they differ from the present invention as hereinafter contrasted.

U.S. Pat. No. 4,209,769 to Chronerberry discloses a system for receiving remote warning signals consisting of a transducer, audio amplifier and tone detecting circuits. This patent differs from the present invention because it does not disclose a microprocessor based system that can detect remote siren signals and further having a four direction indicating system.

U.S. Pat. No. 5,280,632 to Jung-Gon discloses a system for broadcasting and receiving warning signals consisting of a transmitter for sending warning signals. This patent differs from the present invention because it does not disclose any structure for detecting sirens or providing indication of the siren to the driver.

Numerous innovations for warning system devices have been provided in the prior art that are adapted to be used. Even though these innovations may be suitable for the specific individual purposes to which they address, they would not be suitable for the purposes of the present invention as heretofore described.

SUMMARY OF THE INVENTION

In according with the present invention, the vehicle warning system consists of a plurality of siren detectors contained within a vehicle. The output of the siren detectors are connected to the input of a microprocessor contained within the indicating module. The indicating module further containing four visual indicators of direction and a speaker, which are connected to the output of the microprocessor.

Broadly considered, the invention comprises a vehicle warning system that can be easily installed in a vehicle. The warning system can detect sirens from nearby emergency vehicles and can further give a visual as well as an audio indication to the driver. The indicator will consist of the front, back, right and left direction.

Accordingly, it is an object of the present invention to provide a warning system device.

More particularly, it is an object of the present invention to provide a safety system device for vehicles that can detect sirens from approaching emergency vehicles.

In keeping with these objects, and with others which will become apparent hereinafter, one feature of the present invention resides, briefly stated, in that the vehicle warning system device is capable of detecting and warning of sirens of approaching emergency vehicles.

When the vehicle warning system is designed in accordance with the present invention, it can provide the user with an additional vehicle safety measure.

In accordance with another feature of the invention is that when a siren is detected the vehicle radio will automatically shut off.

Another feature of the present invention is that it will have visual as well as audio indication.

Yet another feature of the present invention is that it can aid the audio impaired.

Yet still another feature of the present invention is that the visual indicators will have arrows to aid color blind users.

Still another feature of the present invention is that it can increase traffic safety.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

BRIEF LIST OF REFERENCE NUMERALS UTILIZED IN THE DRAWING

10—indicating module 10
11—microprocessor 11
12—speaker 12
14A—front visual indicator 14A
14B—back visual indicator 14B
14C—left visual indicator 14C
14D—right visual indicator 14D
16A—front siren detector 16A
16B—back siren detector 16B
16C—left siren detector 16C
16D—fight siren detector 16D
18—dashboard 18
20—emergency vehicle 20
22—siren 22
22A—sound waves 22A
30—vehicle 30
31—flow diagram of the microprocessor configuration 31
32—any status signal? block 32
34—radio on? block 34
36—shut off block 36
38—F status? block 38
40—store F status block 40
42—B status? block 42
44—store B status 44
46—L status? block 46
48—store L status block 48
50—R status? block 50
52—store R status block 52
54—>1 status? block 54
56—generate visual indicating signals block 56
58—generate matching indicating voice & visual signals block 58.

DETAILED DESCRIPTION OF THE PREFERRED EMBODIMENT

The vehicle warning system consists of four siren detectors contained within the vehicle 30 of the user. The output of each of the siren detectors are connected to the indicating module 10, which contains the microprocessor 11 and the various indicating devices. The microprocessor 11 further includes a memory to store information.

Figure 1:
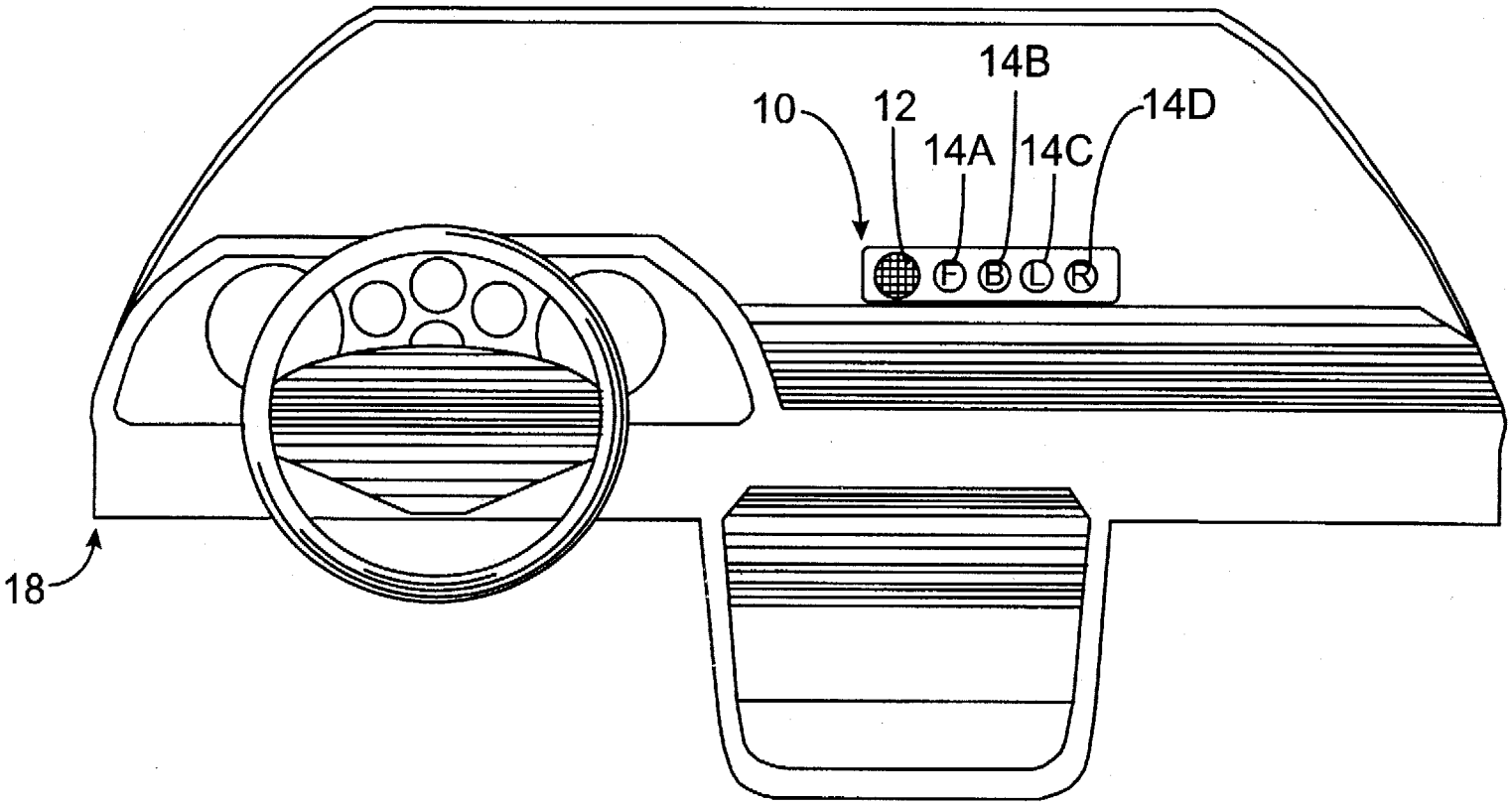
FIG. 1 is a front view of the indicating module mounted on the dashboard of the vehicle.

Firstly referring to FIG. 1 which is a front view of the indicating module 11 mounted on the dashboard 18 of the vehicle 30. Contained within the indicating module 10 is the microprocessor 11. The output of the front siren detector 16A, back siren detector 16B, left siren detector 16C and fight siren detector 16D are each connected to an input of the microprocessor 11. The output of the microprocessor are wired to the input of the speaker 12, front visual indicator 14A which is marked to indicate the front direction, back visual indicator 14B which is marked to indicate the back direction, left visual indicator 14C which is marked to indicate the left direction and right visual indicator 14D which is marked to indicate the fight direction. The front visual indicator 14A, back visual indicator 14B, left visual indicator 14C and right visual indicator 14D are illuminating devices such as bulb or an LED.

The speaker 12, from visual indicator 14A, back visual indicator 14B, left visual indicator 14C and right visual indicator 14D are the indicating devices that will tell the user from what direction the emergency vehicle 20 is approaching from.

Based on the input of the from siren detector 16A, back siren detector 16B, left siren detector 16C and fight siren detector 16D the microprocessor 11 will generate the necessary signals indicating signals. The indicating signals will include a voice indicating signal sent to the speaker 10, where a voice will be generated indicating the direction of the emergency vehicle 30. Also the indicating signals will include visual indicating signals sent to the front visual indicator 14A, back visual indicator 14B, left visual indicator 14C and right visual indicator 14D, which will illuminate the appropriate visual indicator giving the direction of the approaching emergency vehicle 20.

Figure 2:
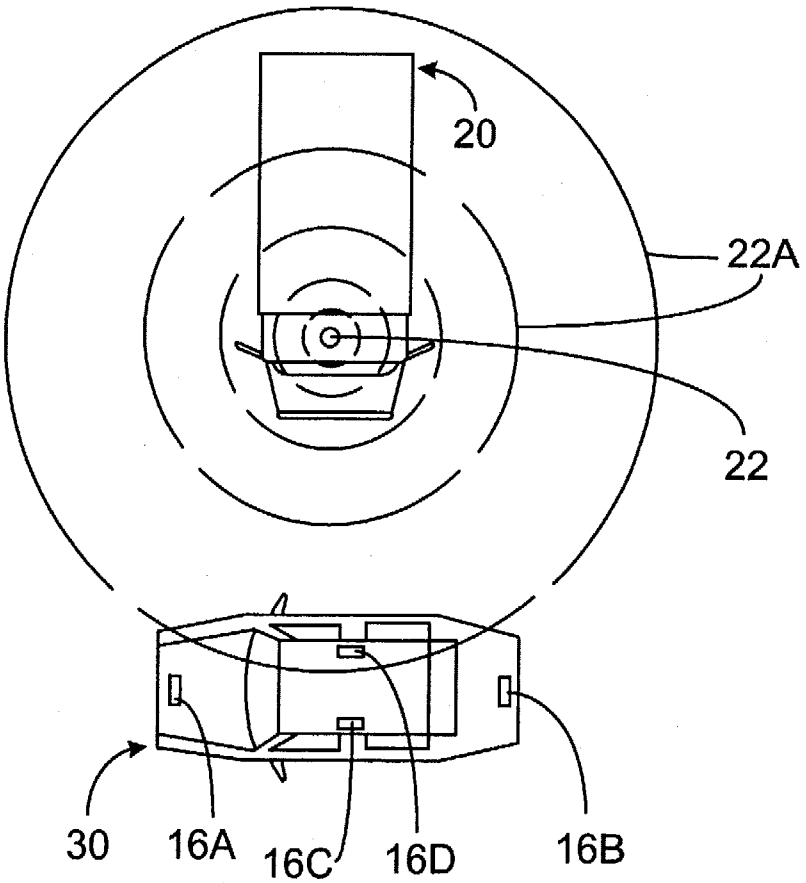
FIG. 2 is a top view of the right siren detector detecting an emergency vehicle to its right.

Referring to FIG. 2 which is a top view of the fight siren detector 16D detecting an emergency vehicle 20 to its fight. The right siren detector 16D is attached to the right side of the vehicle. When the emergency vehicle 20 approaches from the fight, the siren 22 will generate sound waves 22A that will activate the fight siren detector 16D. This will cause the right siren detector 16D to send a R status signal to the input of the microprocessor 11.

Figure 3:
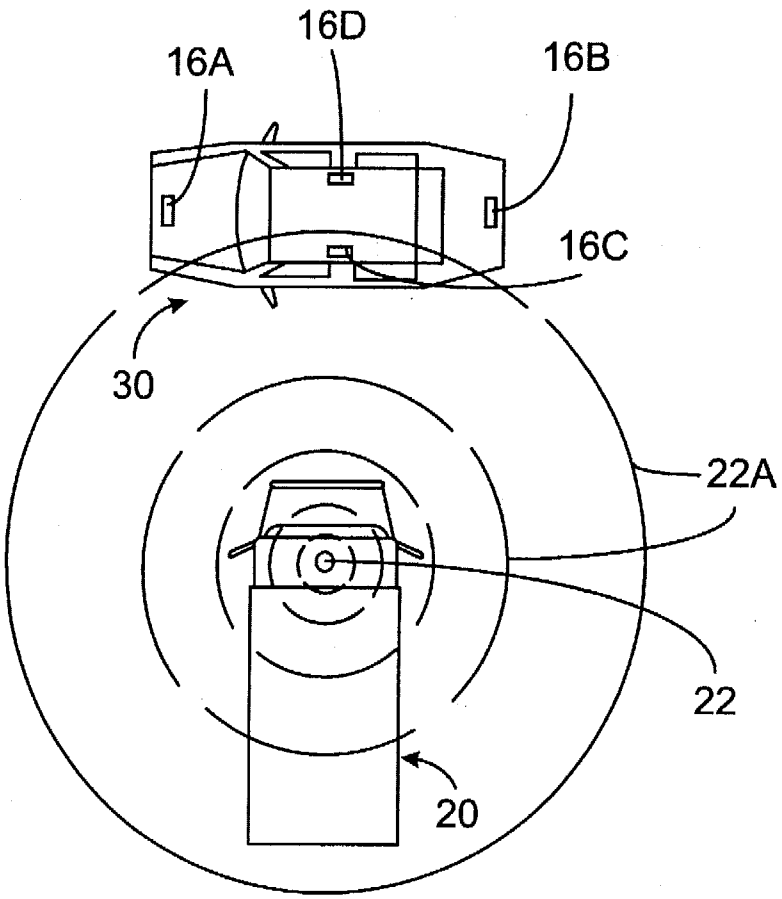
FIG. 3 is a top view of the left siren detector detecting an emergency vehicle to its left.

Referring to FIG. 3 which is a top view of the left siren detector 16C detecting an emergency vehicle 20 to its left. The left siren detector 16C is attached to the left side of the vehicle 30. When the emergency vehicle 20 approaches from the right, the siren 22 will generate sound waves 22A that will activate the left siren detector 16C. This will cause the left siren detector 16C to send a L status signal to the input of the microprocessor 11.

Figure 4:
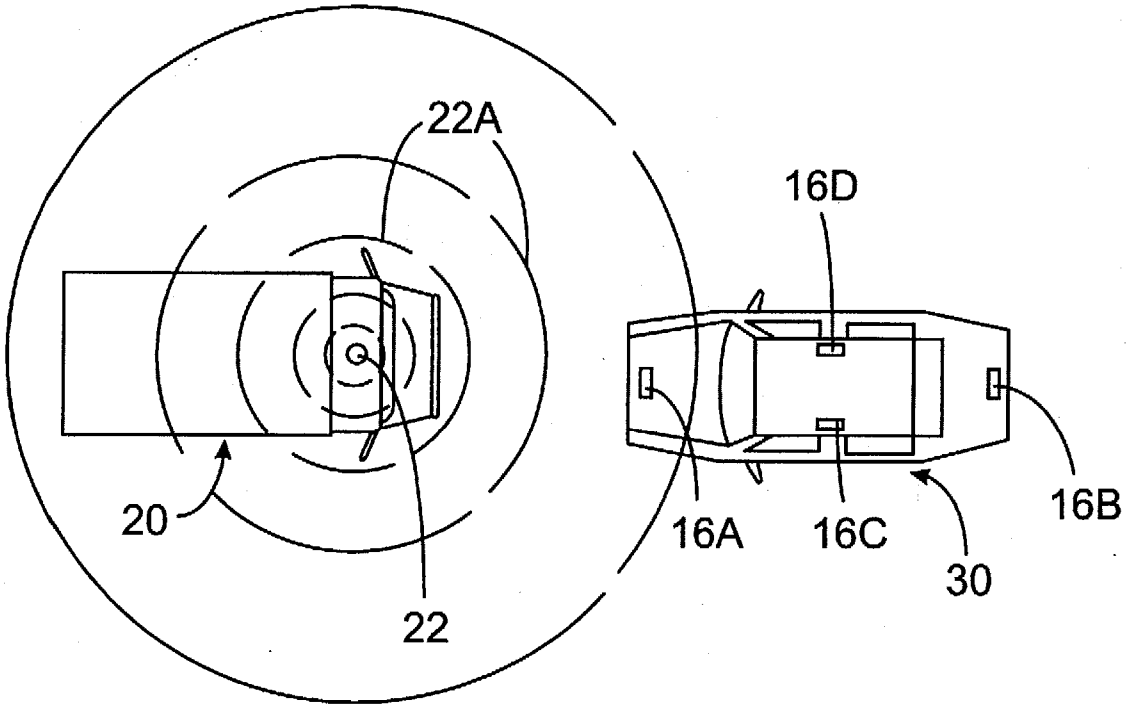
FIG. 4 is a top view of the front siren detector detecting an emergency vehicle to its front.

Referring to FIG. 4 which is a top view of the front siren detector 16A detecting an emergency vehicle 20 to its front. The front siren detector 16A is attached to the front side of the vehicle. When the emergency vehicle 20 approaches from the front, the siren 22 will generate sound waves 22A that will activate the front siren detector 16A. This will cause the front siren detector 16A to send a F status signal to the input of the microprocessor 11.

Figure 5:
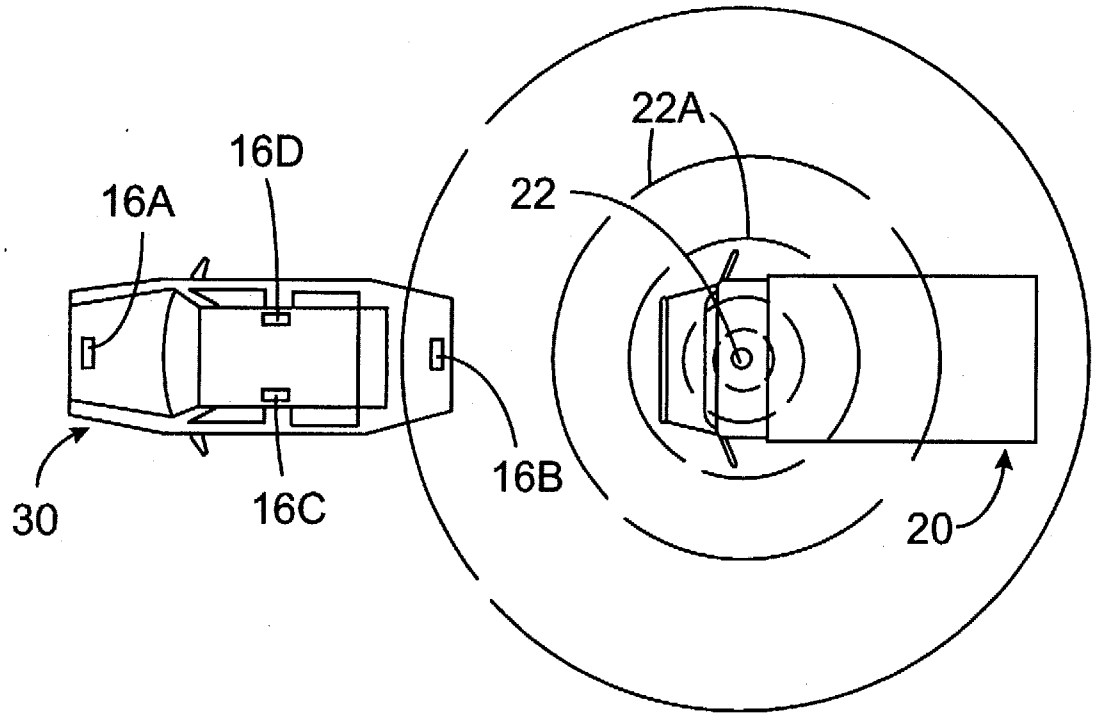
FIG. 5 is a top view of the back siren detector detecting an emergency vehicle to its back.

Referring to FIG. 5 which is a top view of the back siren detector 16B detecting an emergency vehicle 20 to its back. The back siren detector 16B is attached to the back side of the vehicle 30. When the emergency vehicle 20 approaches from the back, the siren 22 will generate sound waves 22A that will activate the back siren detector 16B. This will cause the back siren detector 16B to send a B status signal to the input of the microprocessor 11.

There is a possibility the emergency vehicle 20 will not approach from a front, back, right or left direction. The emergency vehicle 20 could approach at an angle from the vehicle 30, which is not shown in FIGS. 2–5. If this happened, two of either the front siren detector 16A, back siren detector 16B, left siren detector 16C and right siren detector 16D would receive noise waves 22A, which would cause the two siren detectors to generate status signals. The microprocessor 11 is configured to luminate the visual indicators corresponding to the status signals from the two siren detectors. Thus, the user could tell what direction the emergency vehicle was approaching based on the combination of visual indicators. The microprocessor 11 is further configured not to generate any indicating voice signals, when it receives multiple status signals. This is because multiple indicating voice indications would not be useful because it might confuse the user.

Figure 6:
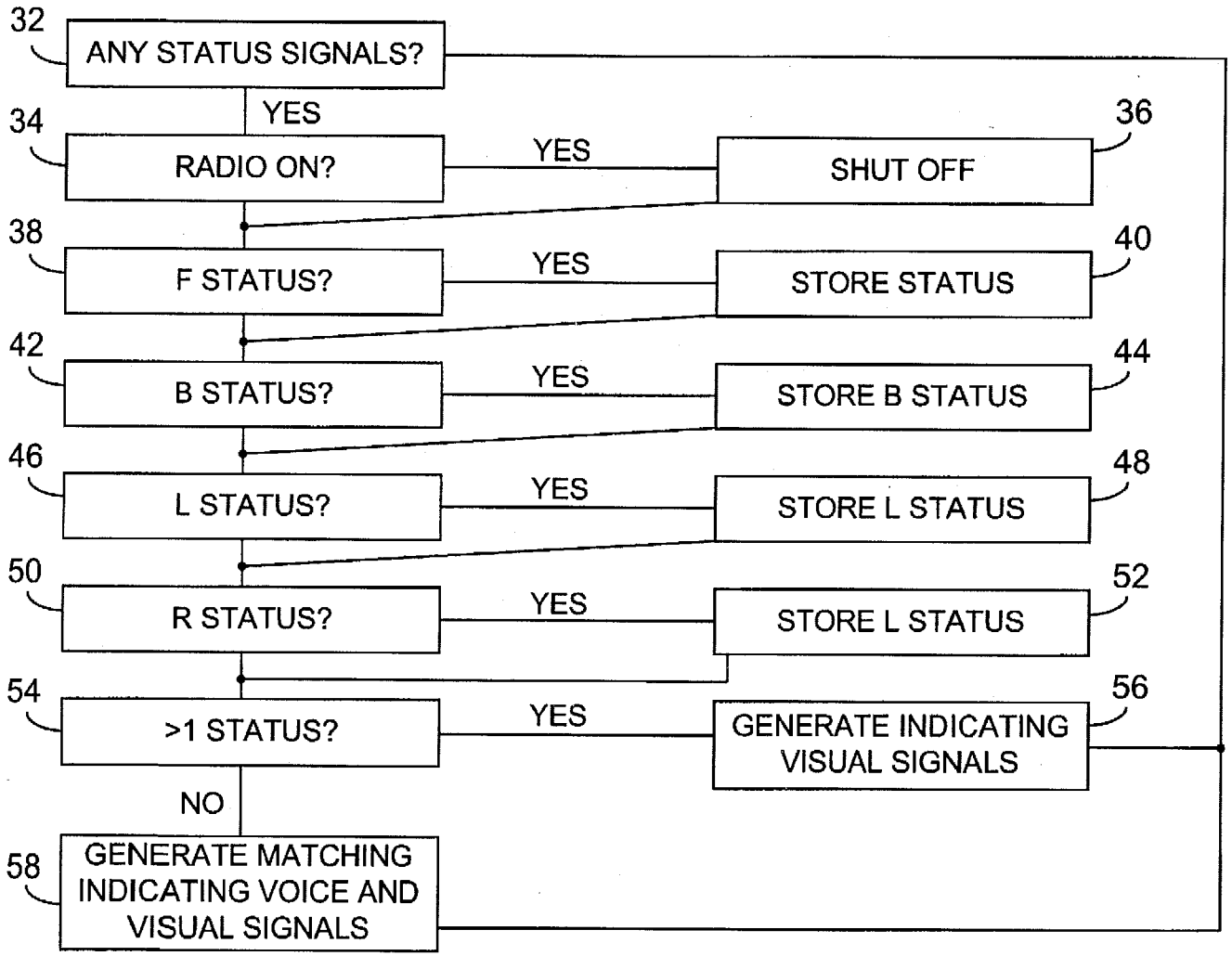
FIG. 6 is a flow diagram of the program for the microprocessor.

Referring to FIG. 6 which is a flow diagram for the program of the microprocessor 31. This flow diagram of the microprocessor 31 is based on the microprocessor receiving status signals from the front siren detector 16A, back siren detector 16B, left siren detector 16C and right siren detector 16D. The any status signal? block 32 is when the program is looking to see if the microprocessor has received any status signal from the four siren detectors, indicating a siren was detected. If a status signal is not received, the program will loop back to the any status signal? block 31. If a status signal is received, the program will move onto the radio on? Box 34.

The radio on block? 34 is when the program sees if the radio in the vehicle 30 is on. If the radio is on, the program will move to shut off block 36. In the shut off box 36 the program will generate a signal to turn the radio off in the vehicle 30, which will enable the user to better hear the siren. An output of the microprocessor 11 will be connected to an electrical switch in the radio, which will enable it to turn the radio off. After turning the radio off, the program will move to the F status? box 38. If the radio in the vehicle 30 is not on, the program will also move to the F status block? 38.

The F status block? 38 is when the program looks to see if any of the status signals it received was a F status signals, which would indicate the front siren detector 16A was activated. If an F status signal was received, the program will move to the store F status block 40. In the F status block, the program will store the F status signal in the memory of the microprocessor 11. After the storing the F status signal, the program will move to the next box. If a F status signal was not received, the program will also move onto the next box. The above sequence will be repeated by the program for the B status signal, L status signal and R status signal, which is indicated by the B status block? 42, store B status 44, L status block? 46, store L status block 48, R status block? 50 and store R status block 52.

After storing all the status signals, the program will move to the >1 status block? 54. In the >1 status? Block 54 the program will go into the memory and see if more than one status signal is stored. If more than one status signal is stored, the program will move to the generate visual indicating signals block 56. In this box, the program will cause the microprocessor 11 to generate visual indicating signals that will luminate at least two of the front visual indicator 14A, back visual indicator 14B, left visual indicator 14C and right visual indicator 14D that correspond to the status signals stored in memory.

If only one status signal is stored in memory of the microprocessor 11, the program will move to the generate matching indicating voice & visual signals block 58. In this box, the program will cause the microprocessor 11 to generate one visual indicating signal and a matching voice indicating signal. The visual indicating signal will luminate one of the four visual indicators corresponding to the stored status signal, while the voice indicating signal will cause the speaker 12 to generate a voice sound corresponding to the stored status signal. This will give the user in the vehicle 30 an audio as well as a visual indication of the direction the emergency vehicle 20 is approaching. After either of the generate visual indicating signals block 56 and generate matching indicating voice & visual signals block 58, the program will loop back to the any status signals? box? 32.

It will be understood that each of the elements described above, or two or more together, may also find a useful application in other types of constructions differing from the type described above.

While the invention has been illustrated and described as embodied in a vehicle warning device, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A safety warning device comprising:

a. a plurality of siren detectors, each siren detector capable of generating a status signal at an output of each siren detector when activated by a siren;

b. a plurality of visual indicators;

c. a speaker;

d. a microprocessor having a plurality of input, a plurality of output and a memory, the microprocessor's plurality of input are connected to each output of the plurality of siren detectors, the microprocessor's plurality of output connected to the speaker and an input of each of the plurality of visual indicators;

e. one of the microprocessor plurality of output connected to an electrical switch in a vehicle radio;

f. the microprocessor configured to receive and store the status signal from each of the plurality of siren detectors in the microprocessor memory, the microprocessor further configured to generate a voice indicating signal and visual indicating signals, wherein both the voice indicating signal and the visual indicating signals correspond to the status signal from each of the plurality of siren detectors stored in the microprocessor memory;

g. the microprocessor further configured to generate a signal to turn off the vehicle radio when the microprocessor receives the status signal from at least one of the plurality of siren detectors; and h. the microprocessor further configured to generate only the visual indicating signals when the microprocessor receives the status signal from at least two of the plurality of siren detectors.

2. A safety warning device comprising:

a. a plurality of siren detectors, each siren detector capable of generating a status signal at an output of each siren detector when activated by a siren;

b. a plurality of visual indicators;

c. a speaker;

d. a microprocessor having a plurality of input, a plurality of output and a memory, the microprocessor's plurality of input are connected to each output of the plurality of siren detectors, the microprocessor's plurality of output connected to the speaker and an input of each of the plurality of visual indicators;

e. the microprocessor configured to generate a voice indicating signal and visual indicating signals, wherein both the voice indicating signal and the visual indicating signals correspond to the status signal from each of the plurality of siren detectors; and f. the microprocessor further configured to generate only the visual indicating signals when the microprocessor receives the status signal from at least two of the plurality of siren detectors.

* * * * *